US009102423B2

(12) United States Patent
Verma

(10) Patent No.: US 9,102,423 B2
(45) Date of Patent: Aug. 11, 2015

(54) FLIP-LOCK INSTANT CLOSURE MECHANISM AND METHOD

(76) Inventor: Vishaal Verma, Evanston, IL (US)

( * ) Notice: Subject to any disclaimer, the term of this patent is extended or adjusted under 35 U.S.C. 154(b) by 351 days.

(21) Appl. No.: 13/485,773

(22) Filed: May 31, 2012

(65) Prior Publication Data

US 2013/0064480 A1 Mar. 14, 2013

Related U.S. Application Data

(60) Provisional application No. 61/519,791, filed on May 31, 2011.

(51) Int. Cl.

| | |
|---|---|
| ***B65D 33/16*** | (2006.01) |
| ***B65D 33/00*** | (2006.01) |
| ***B62D 33/02*** | (2006.01) |
| ***B65D 33/25*** | (2006.01) |
| ***B65B 7/00*** | (2006.01) |
| ***B65D 30/00*** | (2006.01) |
| ***B65D 33/30*** | (2006.01) |

(52) U.S. Cl.
CPC . *B65B 7/00* (2013.01); *B65D 31/00* (2013.01); *B65D 33/30* (2013.01)

(58) Field of Classification Search
CPC ..... B65D 33/30; B65D 33/007
USPC ..... 383/42, 33, 34, 35, 68, 907; 24/30.5 R
See application file for complete search history.

(56) References Cited

U.S. PATENT DOCUMENTS

| | | | |
|---|---|---|---|
| 199,507 | A | 1/1878 | Brubaker |
| 1,463,113 | A | 7/1923 | Bibb |

(Continued)

FOREIGN PATENT DOCUMENTS

| | | | |
|---|---|---|---|
| EP | 2112085 | A1 | 10/2009 |
| GB | 189726598 | A | 11/1898 |

(Continued)

OTHER PUBLICATIONS

Impact Advanced Concepts, "Snap Span" earliest available publication Apr. 8, 2012 at https://web.archive.org/web/20120408231153/http://www.snap-span.com/ downloaded Apr. 29, 2014 (2 pages).

(Continued)

*Primary Examiner* — Jes F Pascua
*Assistant Examiner* — Derek Battisti
(74) *Attorney, Agent, or Firm* — Michael Best & Friedrich LLP

(57) ABSTRACT

One embodiment relates to an instant closure mechanism comprising first and second flat, strip like sealing structures having a first orientation, first and opposing second ends; first and opposing second edges; a first pivot member dividing the sealing structures into an first and second portions, and a contour including at least one curved portion having a large gradual radius intersecting at least one of the first end and the second end. At least two second pivot members having an orientation perpendicular to the first orientation; a tab member enabled to pivot from a first flat position to a second bent position, and a sealing member coupled to the tab member via the horizontal pivot member. The sealing members are joined, providing a sealing interface, and whereby pivoting the tab member imparts a deformation of at least one of the two sealing structures resembling the contour of the first pivot members.

20 Claims, 9 Drawing Sheets

(56) References Cited

U.S. PATENT DOCUMENTS

| | | | | |
|---|---|---|---|---|
| 1,887,940 | A | 11/1932 | Marinsky | |
| 2,008,314 | A | 7/1935 | Russell | |
| 2,040,271 | A | 5/1936 | Rozenweig | |
| 2,074,843 | A * | 3/1937 | Hiering | 150/118 |
| 2,142,904 | A | 1/1939 | Lamarthe | |
| 2,150,627 | A | 3/1939 | Lieber | |
| 2,693,212 | A | 11/1954 | Guichard | |
| 3,313,469 | A | 4/1967 | Drozda | |
| 4,069,994 | A | 1/1978 | Wharmby | |
| 4,486,923 | A | 12/1984 | Briggs | |
| 4,664,348 | A | 5/1987 | Corsaut, III et al. | |
| 4,753,367 | A | 6/1988 | Miller et al. | |
| 4,753,489 | A | 6/1988 | Mochizuki | |
| 4,758,099 | A * | 7/1988 | Branson | 383/44 |
| 4,815,866 | A | 3/1989 | Martone | |
| 5,035,518 | A | 7/1991 | McClintock | |
| 5,037,138 | A | 8/1991 | McClintock et al. | |
| 5,044,774 | A | 9/1991 | Bullard et al. | |
| 5,082,219 | A | 1/1992 | Blair | |
| 5,183,227 | A | 2/1993 | Wilhite | |
| 5,184,896 | A * | 2/1993 | Hammond et al. | 383/33 |
| 5,524,990 | A | 6/1996 | Buck | |
| 5,609,419 | A | 3/1997 | Byers, Jr. | |
| 5,676,306 | A | 10/1997 | Lankin et al. | |
| 5,716,138 | A | 2/1998 | Southwell | |
| 6,022,144 | A * | 2/2000 | Hausslein | 383/33 |
| 6,149,304 | A | 11/2000 | Hamilton et al. | |
| 6,164,821 | A | 12/2000 | Randall | |
| 6,231,235 | B1 | 5/2001 | Galomb et al. | |
| 6,234,674 | B1 | 5/2001 | Byers, Jr. | |
| 6,234,676 | B1 | 5/2001 | Galomb et al. | |
| 6,273,608 | B1 * | 8/2001 | Ward et al. | 383/33 |
| 6,508,587 | B1 | 1/2003 | Byers, Jr. | |
| 6,572,267 | B1 * | 6/2003 | Forman | 383/61.2 |
| 6,578,585 | B1 | 6/2003 | Stachowski et al. | |
| 6,678,923 | B2 * | 1/2004 | Goldberg et al. | 24/30.5 R |
| 6,899,460 | B2 | 5/2005 | Turvey et al. | |
| 6,904,647 | B2 | 6/2005 | Byers, Jr. | |
| 7,681,784 | B2 | 3/2010 | Lang | |
| 8,333,351 | B2 | 12/2012 | Kramer | |
| 2003/0033694 | A1 * | 2/2003 | Cisek | 24/401 |
| 2004/0195467 | A1 | 10/2004 | Passage | |
| 2004/0208400 | A1 * | 10/2004 | Linneweil | 383/68 |
| 2005/0281487 | A1 * | 12/2005 | Pawloski et al. | 383/10 |
| 2006/0010659 | A1 | 1/2006 | Penn | |
| 2006/0280386 | A1 | 12/2006 | Bublitz | |
| 2008/0019618 | A1 | 1/2008 | Dayton et al. | |
| 2009/0046955 | A1 | 2/2009 | Schember et al. | |
| 2011/0188785 | A1 | 8/2011 | Turvey et al. | |
| 2011/0226914 | A1 | 9/2011 | Fleming | |
| 2012/0138623 | A1 | 6/2012 | Verma | |
| 2013/0248541 | A1 * | 9/2013 | Verma | 220/694 |
| 2014/0014789 | A1 | 1/2014 | Verma | |
| 2014/0259868 | A1 | 4/2014 | Verma | |
| 2014/0314342 | A1 | 10/2014 | Verma | |

FOREIGN PATENT DOCUMENTS

| | | | |
|---|---|---|---|
| JP | 51-017122 | U | 2/1976 |
| JP | 2000-085905 | A | 3/2000 |
| JP | 2003-072779 | A | 3/2003 |
| WO | 99/00312 | A | 1/1999 |

OTHER PUBLICATIONS

Jokari Baggy Rack, "Baggy Pack Pro" earliest available publication Nov. 15, 2012 at https://web.archive.org/web/20121115010901/http://www.jokari.com/products/G_169606.html downloaded Apr. 28, 2014 (1 page).

International Search Report and Written Opinion of the International Searching Authority, received for International Patent Application No. PCT/US2014/035154, mailed Aug. 29, 2014 (12 pages).

International Search Report and Written Opinion of the International Searching Authority, received for International Patent Application No. PCT/US2012/068314, mailed Mar. 14, 2013 (6 pages).

International Search Report and Written Opinion of the International Searching Authority, received for International Patent Application No. PCT/US2011/062840, mailed Apr. 23, 2012 (6 pages).

U.S. Patent and Trademark Office Non-final Office Action, received for U.S. Appl. No. 12/958,217, mailed Nov. 6, 2012 (7 pages).

U.S. Patent and Trademark Office Final Office Action, received for U.S. Appl. No. 12/958,217, mailed Apr. 12, 2013 (10 pages).

* cited by examiner

FLIP-LOCK INSTANT CLOSURE MECHANISM AND METHOD

CLAIM FOR PRIORITY

This application claims priority from U.S. Provisional Application Ser. No. 61/519,791 filed May 31, 2011, the complete subject matter of which is incorporated herein by reference in its entirety.

FIELD OF THE INVENTION

The invention relates to a closing mechanism. More particularly, embodiments relate to an instant closure device used with a package, bag, or container and a method of accessing a package, bag, or container having an instant closure mechanism.

BACKGROUND OF THE INVENTION

Pliable containers are widely used to store both edible and non-edible products. For example, snack items, such as various types of chips and cereals, are typically packaged in pliable containers. These containers are generally sealed at both ends for initial packaging purposes and then one end is opened to access the product. It may be desirable to reuse the container to store the product for extended periods of time, allowing repeated access to the interior of the container.

When used to store edible food items for example, it is particularly advantageous to adequately seal the open end of the container between uses in order to prolong the useful life of the products stored therein. For this reason, once the initial seal at one end of the container is broken, it is common practice to roll up the openable end of the pliable container for storage. Unfortunately, the rolled-up ends of such pliable containers generally tend to unroll between uses, which may lead to the food items becoming stale or non-edible.

Proposed solutions to this problem include providing various types of closure mechanisms at the open end of the container to maintain the side walls of the container in a closed relationship for sealing purposes. For example, it is known to use a clip to prevent the openable container end from unrolling. Since such clips are completely separate from the container, they can be misplaced and are therefore often only used when readily available. In addition, these clips often tend to break and only directly maintain a small central section of the openable container end in a rather tight, closed condition. Zip-type or slider type closure arrangements have also become quite prevalent for use with certain types of pliable containers. Such closure arrangements are considered advantageous in that they generally extend across the entire width of the open end and are formed integral to the container. However, such closure arrangements may be expensive and difficult to use due to the required dexterity. In addition, these closure arrangements do not provide an immediate indication that a complete seal has been established. Instead, the entire arrangement must be systematically sealed from one end of the opening to the other and if any portion is not sealed, the purpose of the closure may be completely compromised.

In addition to providing a closure system for closing an open end of a pliable container, it is also considered advantageous to enhance the accessibility to the interior of a container when the container is opened. More specifically, when the container is opened, it is desirable to maintain the side walls of the container in an open configuration, at least at the open end of the container, to permit easy access to the contents.

For the foregoing reasons, there is a need for a simple, inexpensive closure system for use with pliable containers that will both improve resealing functionality when in the closed or sealed configuration and enhance accessibility to withheld contents when in the open configuration.

SUMMARY OF THE INVENTION

One embodiment relates to an instant closure mechanism including a first flat, strip like sealing structure and a second flat, strip like sealing structure. The first sealing structure has a first orientation defined with respect to a length of the first sealing structure, the first sealing structure having: a first end; a second end opposite the first end; a first edge; a second edge opposite the first edge; a first pivot member substantially parallel to the first orientation extending between the first end and the second end and dividing the first structure into a first portion proximate the first edge and a second portion proximate the second edge, and having a contour including at least one curved portion having a large gradual radius intersecting at least one of the first end and the second end; at least two second pivot members each having a straight contour and located proximate the first end and the second end, the pivot members having an orientation substantially perpendicular to the first orientation; a tab member located in the first portion, the tab member enabled to pivot about the first pivot member between a first flat position and a second bent position, providing a surface region for a user to apply pressure; and a sealing member located in the first sealing structure second portion and coupled to the tab member via the first pivot member. The second sealing structure has a first orientation defined with respect to a length of the second sealing structure and positioned relative to the first sealing structure, the second sealing structure having: a first end; a second end opposite the first end; a first edge; a second edge opposite the first edge; a first pivot member substantially parallel to the first orientation extending between the first end and the second end and dividing the second sealing structure into a first portion proximate the first edge and a second portion proximate the second edge, and having a contour including at least one curved portion having a large gradual radius intersecting at least one of the first end and the second end; at least two second pivot members each having a straight contour and located proximate the first end and the second end, the pivot members having an orientation substantially perpendicular to the first orientation; a tab member located in the first portion, the tab member enabled to pivot about the first pivot member between a first flat position and a second bent position; and a sealing member located in the second sealing structure second portion and coupled to the tab member via the first pivot member, whereby the sealing members are joined, providing a sealing interface between the first sealing structure and the second sealing structure.

Another embodiment relates to a resealable container including at least one flexible container defining an interior and an instant closure mechanism mounted to the flexible container. The at least one flexible container includes at least one closed end; and at least one open end enabling access to the interior. The instant closure mechanism mounted to the flexible container includes a first flat, strip like sealing structure and a second flat, strip like sealing structure. The first sealing structure has a first orientation defined with respect to the at least one open end of the flexible container and defining an axis, the first sealing structure having: a first end; a second end opposite the first end; a first pivot member substantially parallel to the first orientation extending between the first end and the second end and dividing the first sealing structure into an upper portion and a lower portion, the first pivot member having a contour including at least one linear portion having a slight draft at a selected angle with respect to the axis and intersecting at least one of the first end and the second end and at least one curved portion having a large gradual radius intersecting at least one of the first end and the second end, the at least one curved portion tangent to the linear portion; at least two second pivot members each having a straight contour and located proximate the first end and the second end, the pivot members having an orientation substantially perpendicular to the first orientation; a tab member located in the upper portion, the tab member enabled to pivot about the first pivot member between a first flat position and a second bent position, providing a surface region for a user to apply pressure; and a sealing member located in the second portion and coupled to the tab member via the first pivot member. The second flat, strip like sealing structure having a first orientation defined with respect to the open end of the flexible container, the second sealing structure having: a first end; a second end opposite the first end; a first pivot member substantially parallel to the first orientation extending between the first end and the second end and dividing the second sealing structure into an upper portion and a lower portion, the first pivot member having a contour including at least one linear portion having a slight draft at a selected angle with respect to the axis and intersecting at least one of the first end and the second end and at least one curved portion having a large gradual radius intersecting at least one of the first end and the second end, the at least one curved portion tangent to the linear portion; at least two second pivot members each having a straight contour and located proximate the first end and the second end, the pivot members having an orientation substantially perpendicular to the first orientation; a tab member located in the first portion, the tab member enabled to pivot about the first pivot member between a first flat position and a second bent position; and a sealing member located in the second portion and coupled to the tab member via the first pivot member, whereby the sealing members are joined, providing a sealing interface between the first sealing structure and the second sealing structure, and whereby pivoting of the tab member imparts a deformation of at least one of the two sealing structures resembling the contour of the first pivot member.

Yet another embodiment relates to a method for accessing and sealing a resealable container, the resealable container including at least one flexible container and an instant closure mechanism mounted to the flexible container. The at least one flexible container defines an interior and includes at least one closed end; and at least one open end enabling access to the interior. The instant closure mechanism mounted to the flexible container includes a first flat, strip like sealing structure and a second flat, strip like sealing structure. The first flat, strip like sealing structure has a first orientation defined with respect to the at least one open end of the flexible container, the first sealing structure having: a first end; a second end opposite the first end; a first pivot member substantially parallel to the first orientation extending between the first end and the second end and dividing the first sealing structure into an upper portion and a lower portion, and having a contour including at least one curved portion having a large gradual radius intersecting at least one of the first end and the second end; at least two second pivot members each having a straight contour and located proximate the first end and the second end, the pivot members having an orientation substantially perpendicular to the first orientation; a tab member located in the upper portion, the tab member enabled to pivot about the first pivot member between a first flat position and a second bent position, providing a surface region for a user to apply pressure; and a sealing member located in the second portion and coupled to the tab member via the first pivot member. The second flat, strip like sealing structure having a first orientation defined with respect to the open end of the flexible container, the second sealing structure having: a first end; a second end opposite the first end; a first pivot member substantially parallel to the first orientation extending between the first end and the second end and dividing the second sealing structure into an upper portion and a lower portion, and having a contour including at least one curved portion having a large gradual radius intersecting at least one of the first end and the second end; at least two second pivot members each having a straight contour and located proximate the first end and the second end, the pivot members having an orientation substantially perpendicular to the first orientation; a tab member located in the first portion, the tab member enabled to pivot about the first pivot member between a first flat position and a second bent position; and a sealing member located in the second portion and coupled to the tab member via the first pivot member, whereby the sealing members are joined, providing a sealing interface between the first sealing structure and the second sealing structure, and whereby pivoting of the tab member imparts a deformation of at least one of the two sealing structures resembling the contour of the first pivot member. The method for sealing the flexible container includes applying a downwards force relative to the orientation of the instant closure mechanism to any portion of the tab members of the first flat, strip like sealing structure or the second flat, strip like sealing structure; pivoting the tab members of the first flat, strip like sealing structure and the second flat, strip like sealing structure about the respective first pivot members; deforming the sealing members of the first flat, strip like sealing structure and the second flat, strip like sealing structure along the contour of the respective first pivot members; moving the tab members of the first sealing structure and the second sealing structure from the first flat position to a second bent position, whereby the linear portion of the first sealing structure follows the contour of the curved portion of the second sealing structure, the curved portion of the second sealing structure applying a pressure to the linear portion of the first sealing structure, the deformation of the first sealing structure creating a tensioning effect between the first end and second end thereby creating a sealing pressure between the first sealing structure and the second sealing structure, and further whereby the linear portion of the second sealing structure follows the contour of the curved portion of the first sealing structure, the curved portion of the first sealing structure applying a pressure to the linear portion of the second sealing structure, the deformation of the second sealing structure creating a tensioning effect between the first end and second end thereby creating a sealing pressure between the first sealing structure and the second sealing structure.

Still another embodiment relates to a method for providing a scooping and pouring function using an instant closure mechanism, the instant closure mechanism including at least one flexible container defining an interior and an instant closure mechanism mounted to the flexible container. The at least one flexible container includes at least one closed; and at least one open end enabling access to the interior. The instant closure mechanism mounted to the flexible container includes a first flat, strip like sealing structure and a second flat, strip like sealing structure. The first sealing structure has a first orientation defined with respect to the at least one open end of the flexible container, the first sealing structure having: a first end; a second end opposite the first end; a first pivot member substantially parallel to the first orientation extending between the first end and the second end and dividing the first flat sealing structure into an upper portion and a lower portion, and having a contour including at least one curved portion having a large gradual radius intersecting at least one of the first end and the second end; at least two second pivot members each having a straight contour and located proximate the first end and the second end, the pivot members having an orientation substantially perpendicular to the first orientation; a tab member located in the upper portion, the tab member enabled to pivot about the first pivot member between a first flat position and a second bent position, providing a surface region for a user to apply pressure; and a sealing member located in the first sealing structure second portion and coupled to the tab member via the first pivot member. The second sealing structure has a first orientation defined with respect to the open end of the flexible container, the second sealing structure having: a first end; a second end opposite the first end; a first pivot member substantially parallel to the first orientation extending between the first end and the second end and dividing the second sealing structure into an upper portion and a lower portion, and having a contour including at least one curved portion having a large gradual radius intersecting at least one of the first end and the second end; at least two second pivot members each having a straight contour and located proximate the first end and the second end, the pivot members having an orientation substantially perpendicular to the first orientation; a tab member located in the first portion, the tab member enabled to pivot about the first pivot member between a first flat position and a second bent position; and a sealing member located in the second portion and coupled to the tab member via the first pivot member, whereby the sealing members are joined, providing a sealing interface between the first sealing structure and the second sealing structure, and whereby pivoting of the tab member imparts a deformation of at least one of the two sealing structures resembling the contour of the first pivot members. The method for providing a scooping and pouring function includes applying an upwards force relative to the orientation of the instant closure mechanism to any portion of the tab members of the first sealing structure or the second sealing structure; pivoting the tab members of the first sealing structure and the second sealing structure about the respective first pivot members; moving the tab members of the first sealing structure and the second sealing structure from the second bent position to the first flat position; applying a slight pressure to the first ends and second ends of the first sealing structure and the second sealing structure, resulting in the first sealing structure and the second sealing structure flexing and pivoting about at least one of the second pivot members of the first and second sealing structures, forming a scoop-like element; and scooping elements or pouring elements using the scoop-like element.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION

Embodiments of the present invention are designed to replace the inconvenient functionality of the conventional zip type closure mechanism. It can be used in any application requiring an instant seal where the user is only required to apply a light pressure to open and close the seal. In at least one embodiment, the mechanism is comprised of a first and second flat, strip like sealing structure semi-rigid, semi-flexible, or flexible in nature. Each structure is designed as a completely flat strip including a first horizontally oriented pivot member and two second vertically oriented pivot members. The first horizontally oriented pivot member (typically a living hinge) includes a contour comprising one or more linear portions and one or more curved portions allowing a tab member to pivot between a first unlocked biased configuration and a second locked (or sealed) biased configuration. The two second vertically oriented pivot members (typically living hinges) allow the sealing structures to pivot relative to one another vertically thus allowing for an open/close functionality with a slight pressure applied to the ends of the mechanism. The first pivot member results in a division of the structure, separating it into a sealing member and tab member. The first structure is bonded to the second structure through their opposing ends thus creating a continuous closure mechanism. When the tab component is rotated about the first pivot member, the sealing member deforms following the same contour as the corresponding first pivot member. As a continuous closure mechanism, this deformation creates a biased tensioning effect between bonded ends of the closure thus creating a sealing pressure between sealing members. Through this effect, the adjacent tab members are held in the downwards and locked configuration until a slight upwards pressure is applied to one or more of the tab members thereby releasing the applied sealing pressure and returning each tab member to the flat and upwards position. At this point, each structure has the ability to bend and flex normal to the direction of the fold and parallel to the direction of bonding at the end of the mechanism. With a slight pressure applied to the bonded ends of the mechanism, the user has the ability to open the attached container with ease thereby exposing the contents of the container for dispensing.

Figure 1:
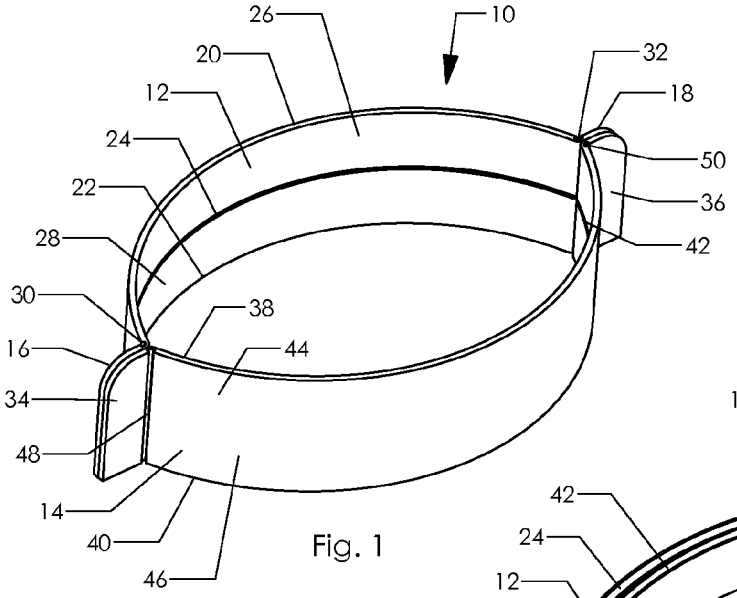
FIG. 1 is an isometric view of the closure mechanism in an open configuration in accordance with one embodiment.
Figure 2:
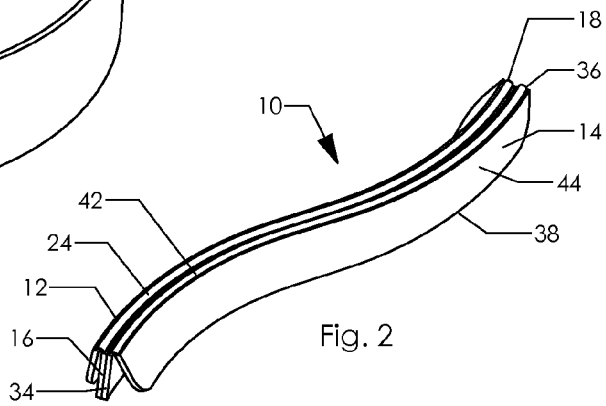
FIG. 2 is an isometric view of the closure mechanism in a closed configuration in accordance with one embodiment.

More particularly, FIGS. 1-2 depict isometric views of the flip-lock instant closure mechanism, generally designated 10, in accordance with one embodiment of the present invention, depicting the closure device 10 in a first or open configuration in FIG. 1 and a second or closed and locked configuration in FIG. 2.

In the illustrated embodiment, the closure mechanism 10 includes at least a first flat, strip like sealing structure 12 and a second flat, strip like sealing structure 14. As illustrated, the first flat, strip like sealing structure 12 has a first orientation defined with respect to a length of the flat, strip like sealing structure 12, a first end 16, a second end 18 opposite the first end 16, a first edge 20, and a second edge 22 opposite the first edge 20. The first flat, strip like sealing structure 12 includes a first or horizontal pivot member 24 substantially parallel to the first orientation extending between the first end 16 and the second end 18 and dividing the first flat, strip like sealing structure 12 into a first or upper portion 26 proximate the first edge 20 and a second or lower portion 28 proximate the second edge 22. In the illustrated embodiment, the first flat, strip like sealing structure 12 includes at least one but generally two second or vertical pivot members 30 and 32, each pivot member 30 and 32 have a straight contour and are located proximate the first end 16 and the second end 18, where the pivot members 30 and 32 having an orientation substantially perpendicular to the first orientation.

In the illustrated embodiment, the second flat, strip like sealing structure 14 has a first orientation defined with respect to a length of the flat, strip like sealing structure 14, a first end 34, a second end 36 opposite the first end 34, a first edge 38, and a second edge 40 opposite the first edge 38. The second flat, strip like sealing structure 14 includes a first or horizontal pivot member 42 (See FIG. 4) substantially parallel to the first orientation extending between the first end 34 and the second end 36 and dividing the second flat, strip like sealing structure 14 into a first or upper portion 44 proximate the first edge 38 and a second or lower portion 46 proximate the second edge 40. In the illustrated embodiment, the second flat, strip like sealing structure 14 includes at least one but generally two second or vertical pivot members 48 and 50, each pivot member 48 and 50 have a straight contour and are located proximate the first end 34 and the second end 36, where the pivot members 48 and 50 having an orientation substantially perpendicular to the first orientation. The first flat, strip like sealing structure 12 and the second flat, strip like sealing structure 14 are comprised of any suitable material including a semi-rigid and flexible plastic material. The plastic material may be selected from the group comprising at least polypropylene, polyethylene or some combination thereof. It is contemplated that the sealing structures may be comprised of the same or different material. For example, one sealing structure may be comprised of polypropylene while the other is comprised of polyethylene.

Figure 3A:
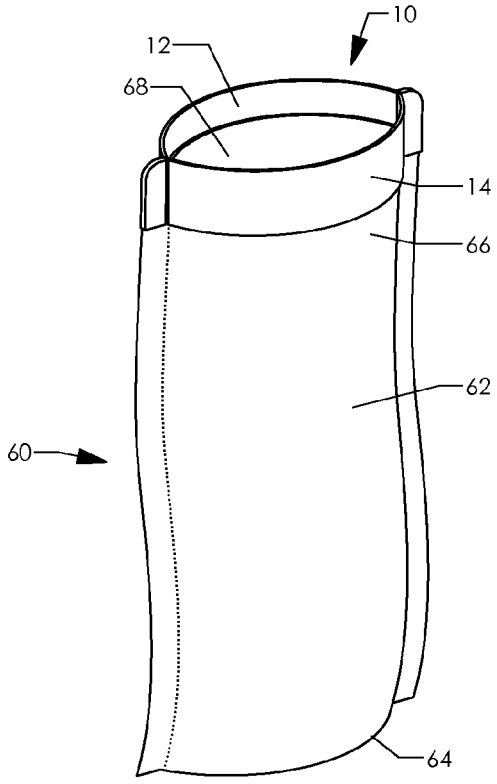
FIG. 3A is an isometric view of a flexible container having the closure mechanism of FIG. 1 in an open position in accordance with one embodiment.
Figure 3B:
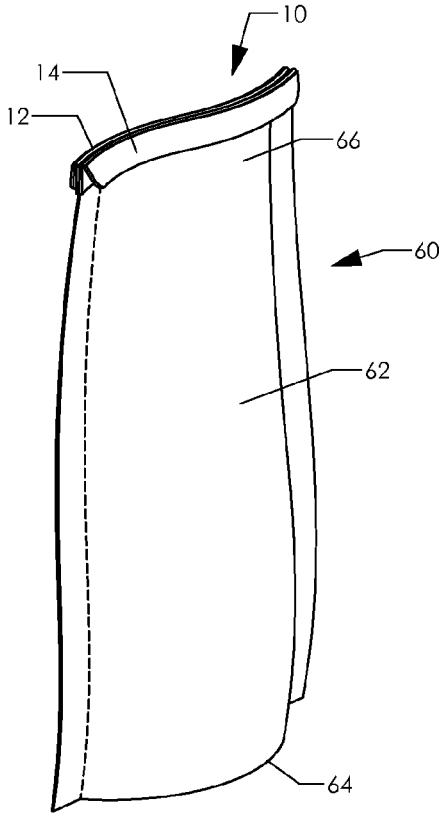
FIG. 3B is an isometric view of the flexible container having the closure device in a closed configuration similar to that of FIG. 2 in accordance with one embodiment.
Figure 4A:
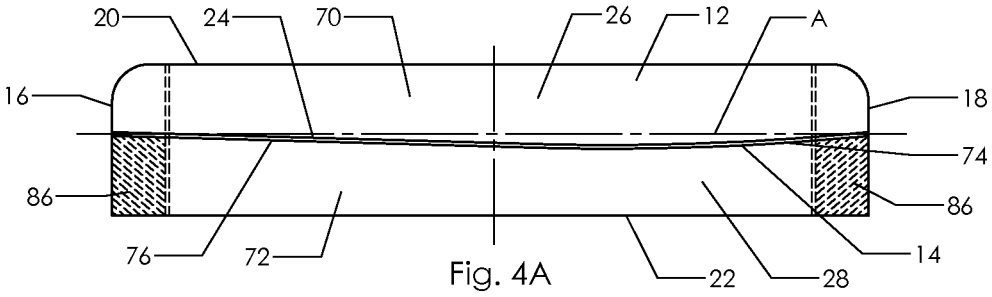
FIG. 4A is a front view of the closure mechanism of FIG. 1 in accordance with one embodiment.

FIGS. 3A & 3B are isometric views of a flexible container, generally designated 60, having the closure mechanism 10 in an open configuration. Container 60 includes at least two sidewalls 62, a closed end 64 and at least one open end 66. At least the side walls 62 and closed end 64 define an interior 68. The closure mechanism 10 is positioned proximate the open end 66, such that each of the first flat, strip like sealing structure 12 and second flat, strip like sealing structure 14 having a first orientation defined with respect to the open end 66. It is contemplated that the container 60 with the closure mechanism 10 are formed in one manufacturing process with the closure mechanism 10 integral to the container 60. Alternatively, the container 60 and closure mechanism 10 may be formed in a separate process and joined together using an adhesive bonding, heat sealing, over molding, ultrasonic welding or some combination as known in the art. FIG. 4A is a flat view of the closure mechanism 10 of FIG. 1. Further, the container 60 and the closure mechanism 10 may be formed of the same or different material.

Figure 4B:
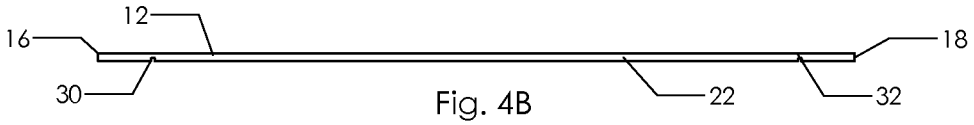
FIG. 4B is an end view of the closure mechanism in accordance with one embodiment.
Figure 4C:
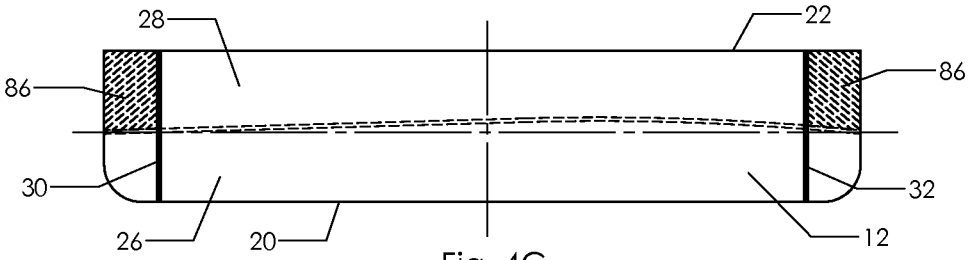
FIG. 4C is a back view of the closure mechanism in accordance with one embodiment.

FIGS. 4A-4C illustrate the first flat, strip like sealing structure 12 having a tab member 70 located in the first portion 26 of the first flat, strip like sealing structure 12, the tab member 70 enabled to pivot about the first pivot member 24 between a first flat position to a second bent position, providing a surface region for a user to apply pressure. FIG. 4A depicts a front view of the first flat, strip like sealing structure 12 having a sealing member 72 located in the second portion 28 of the first flat, strip like sealing structure 12 and coupled to the tab member 70 via the horizontal pivot member 24. FIG. 4A further illustrates the first flat, strip like sealing structure 12 defines an axis A with respect to the first orientation. The first flat, strip like sealing structure 12 further includes a first pivot member 24 with a contour including at least one curved portion 74 and a linear portion 76. The curved portion 74 has a large gradual radius intersecting at least one of the first end 16 and the second end 18. The linear portion 76 has a slight draft at a selected angle with respect to the axis A and intersecting at least one of the first end 16 and the second end 18, the at least one curved portion 74 tangent to the liner portion 78. In at least one embodiment, the selected angle of the slight draft is between about 0 and 5 degrees with respect to the axis A. FIG. 4C depicts a back view of the first flat, strip like sealing structure 12 having first portion 26 and second portion 28 in addition to vertical pivot members 30 and 32. FIGS. 4A and 4C further illustrate the first flat, strip like sealing structure 12 includes a bonding area 86. As illustrated, the first flat, strip like sealing structure 12 has two bonding areas 86 located proximate the first and second ends 16 & 18.

Figure 5:
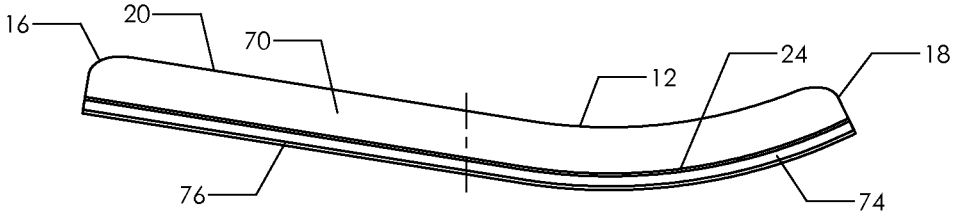
FIG. 5 is a top view of the closure mechanism wherein the sealing structure pivots about the horizontal pivot member in accordance with one embodiment.

FIG. 5 depicts a view of the first sealing structure 12 wherein the sealing structure pivots about the first horizontal pivot member 24 the sealing member 72 following the contour of the first pivot member 24 in accordance with one embodiment.

Figure 6:
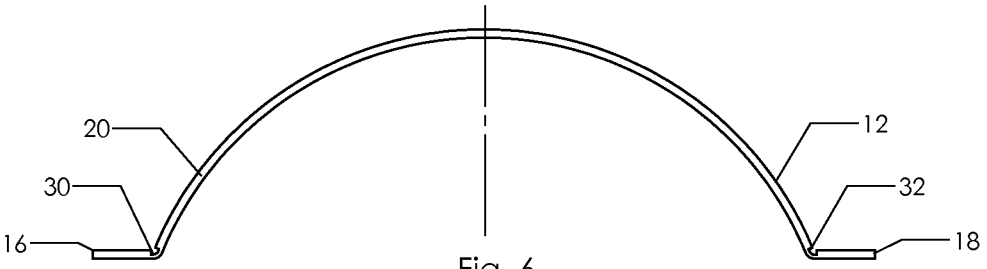
FIG. 6 is top view of the sealing structure pivoting about the vertical pivot members in accordance with one embodiment.

FIG. 6 depicts a top view of the sealing structure pivoting about the vertical pivot members 30 and 32 in accordance with one embodiment.

Figure 7:
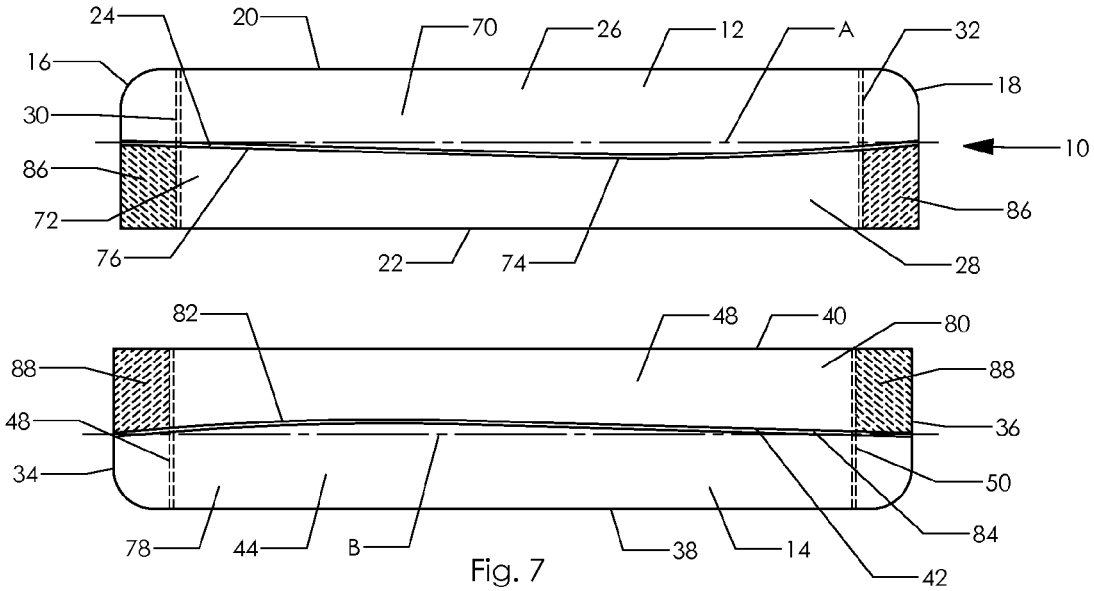
FIG. 7 is a top view of the closure mechanism assembly with opposing sealing structures in a flat position in accordance with one embodiment.

FIG. 7 illustrates the first flat, strip like sealing structure 12 having a tab member 70 located in the first portion 26 of the first flat, strip like sealing structure 12, the tab member 70 enabled to pivot about the first pivot member 24 between a first flat position to a second bent position, providing a surface region for a user to apply pressure. FIG. 7 further depicts the first flat, strip like sealing structure 12 having a sealing member 72 located in the second portion 28 of the first flat, strip like sealing structure 12 and coupled to the tab member 70 via the horizontal pivot member 24. FIG. 7 further illustrates the first flat, strip like sealing structure 12 defines an axis A with respect to the first orientation. The first flat, strip like sealing structure 12 further includes a first pivot member 24 with a contour including at least one curved portion 74 and a linear portion 76. The curved portion 74 has a large gradual radius intersecting at least one of the first end 16 and the second end 18. The linear portion 76 has a slight draft at a selected angle with respect to the axis A and intersecting at least one of the first end 16 and the second end 18, the at least one curved portion 74 tangent to the liner portion 78. In at least one embodiment, the selected angle of the slight draft is between about 0 and 5 degrees with respect to the axis A.

The second flat, strip like sealing structure 14 as illustrated in FIG. 7 has a tab member 78 located in the first portion 44 of the second flat, strip like sealing structure 14, the tab member 78 enabled to pivot about the first pivot member 42 between a first flat position to a second bent position, providing a surface region for a user to apply pressure. FIG. 7 further depicts the second flat, strip like sealing structure 14 having a sealing member 80 located in the second portion 46 of the second flat, strip like sealing structure 14 and coupled to the tab member 78 via the horizontal pivot member 42. FIG. 7 further illustrates the second flat, strip like sealing structure 14 defines an axis B with respect to the first orientation. The second flat, strip like sealing structure 14 further includes a first pivot member 42 with a contour including at least one curved portion 82 and a linear portion 84. The curved portion 82 has a large gradual radius intersecting at least one of the first end 34 and the second end 36. The linear portion 84 has a slight draft at a selected angle with respect to the axis B and intersecting at least one of the first end 34 and the second end 36, the at least one curved portion 82 tangent to the liner portion 84. In at least one embodiment, the selected angle of the slight draft is between about 0 and 5 degrees with respect to the axis B.

Figure 8:
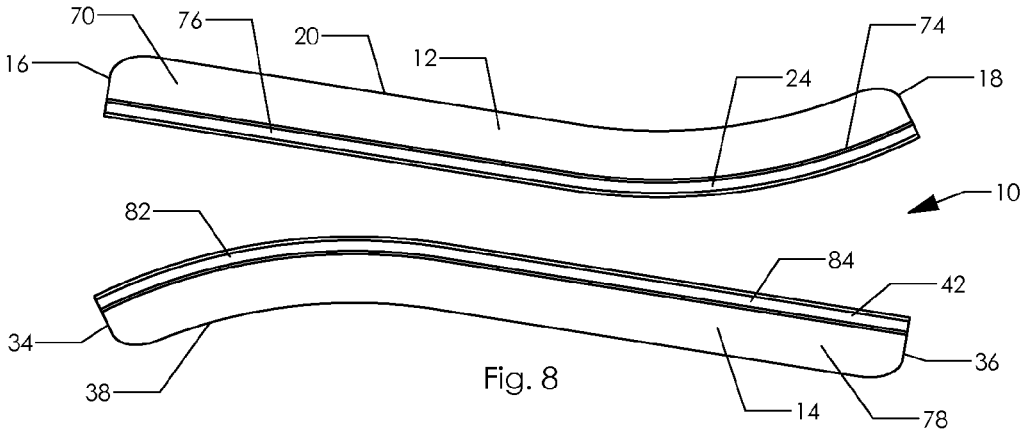
FIG. 8 is a top view of the closure mechanism assembly with opposing sealing structures separated and pivoting about a horizontal pivot member in accordance with one embodiment.
Figure 9:
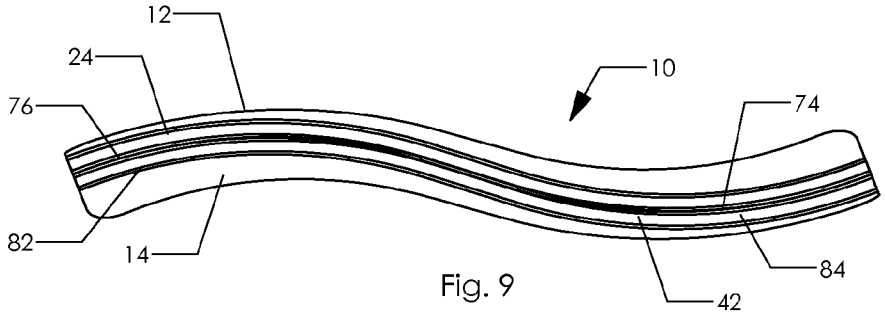
FIG. 9 is a top view of the opposing sealing structure mated and joined at ends creating an air tight closure mechanism in accordance with one embodiment.
Figure 10:
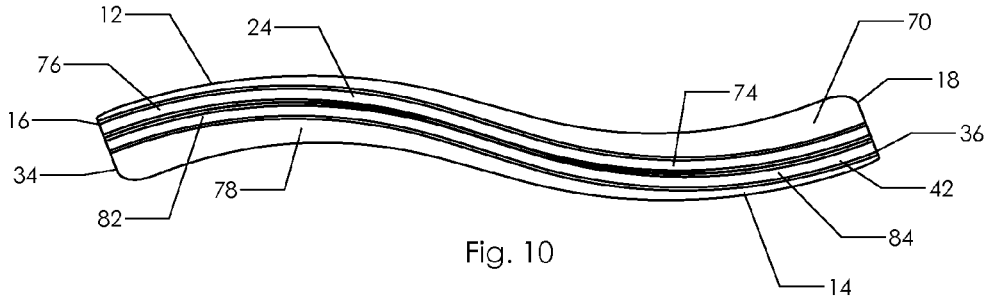
FIG. 10 is a top view of the closure mechanism in a closed and locked configuration in accordance with one embodiment.
Figure 11:
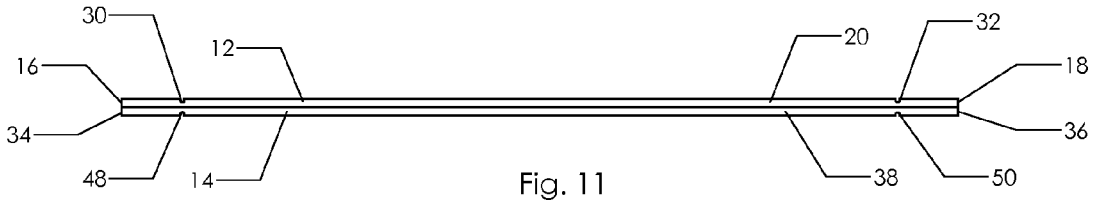
FIG. 11 is a top view of the closure mechanism in an unlocked configuration in accordance with one embodiment.
Figure 12:
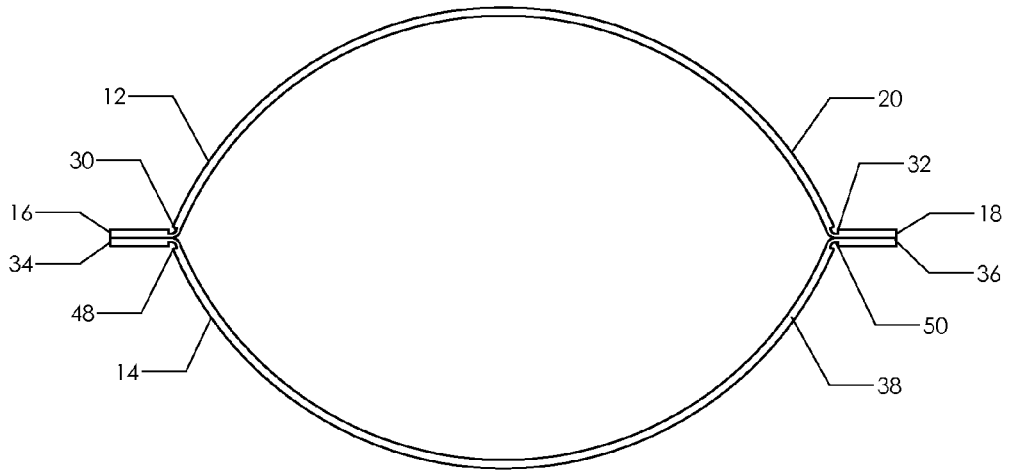
FIG. 12 is a top view of the closure device in an open configuration in accordance with one embodiment.

FIGS. 8 depicts a top view of the closure mechanism 10 with sealing structures 12 and 14 separated pivoting about horizontal pivot members 24 & 42; FIG. 9 is a top view of the opposing sealing structures mated and joined at ends 16, 18, 34 & 36, creating an air tight closure mechanism 10; FIG. 10 is a top view of the closure mechanism 10 in a closed and locked configuration; FIG. 11 is a top view of the closure mechanism 10 in an unlocked configuration; while FIG. 12 is a top view of the closure device 10 in an open configuration. As provided previously, the first flat, strip like sealing structure 12 has the sealing member 72 located in the second portion 28 and coupled to the tab member 70 via the horizontal pivot member 24, while the second flat, strip like sealing structure 14 has the sealing member 80 located in the second portion 46 of the second flat, strip like sealing structure 14 and coupled to the tab member 78 via the horizontal pivot member 42, whereby the sealing members 72 & 80 are joined, providing a sealing interface between the first flat, strip like sealing structure 12 and the second flat, strip like sealing structure 14 (best viewed in FIGS. 9-12). FIG. 7 further illustrates the first flat, strip like sealing structure 12 and the second, flat strip like sealing structure 14 each include a bonding area 86 and 88. As illustrated, the first flat, strip like sealing structure 12 has two bonding areas 86 located proximate the first and second ends 16 & 18, while the second, flat strip like sealing structure 14 likewise has two bonding areas 88 located proximate the first and second ends 34 & 36.

In at least one embodiment, the linear portion 76 of the first flat, strip like sealing structure 12 mates proximate the curved portion 82 of the second flat, strip like sealing structure 14, while the linear portion 84 of the second flat, strip like sealing structure 14 mates proximate the curved portion 74 of first flat, strip like sealing structure 12 (best viewed in FIGS. 8-10). Pivoting the tab members 70 & 78 imparts a deformation of at least one or both of the two flat, strip like sealing structures 12 & 14 resembling the contour of the first pivot members 24 & 42 (best viewed in FIGS. 9-10). As illustrated in FIGS. 11-12, the first flat, strip like sealing structure 12 has two bonding areas 86 located proximate the first and second ends 16 & 18, while the second, flat strip like sealing structure 14 likewise has two bonding areas 88 located proximate the first and second ends 34 & 36. In this manner, the first flat, strip like sealing structure 12 is bonded to the second flat, strip like sealing structure 14 via the bonding areas 86 & 88. In at least one embodiment, the first flat, strip like sealing structure 12 is bonded to the second flat, strip like sealing structure 14 using at least one of an adhesive bonding, heat sealing, over molding, or ultrasonic welding processes. As provided previously, the first flat, strip like sealing structure 12 and second flat, sealing structure 14 each include tabs 70 & 78, each tab members 70 & 78 enabled to pivot about the first pivot members 24 & 42 from a first flat position to a second bent position (best viewed in FIGS. 9-10), such the closure mechanism 10 moves from a mated and flat configuration as illustrated in FIG. 11 to a closed and locked configuration (best viewed in FIGS. 9-10) and back. Further, the closure mechanism 10 moves from a mated and flat configuration illustrated in FIG. 11 to a separated and open configuration illustrated in FIG. 12 by applying a slight pressure to opposing ends 16, 18, 34, and 36.

Figure 13:
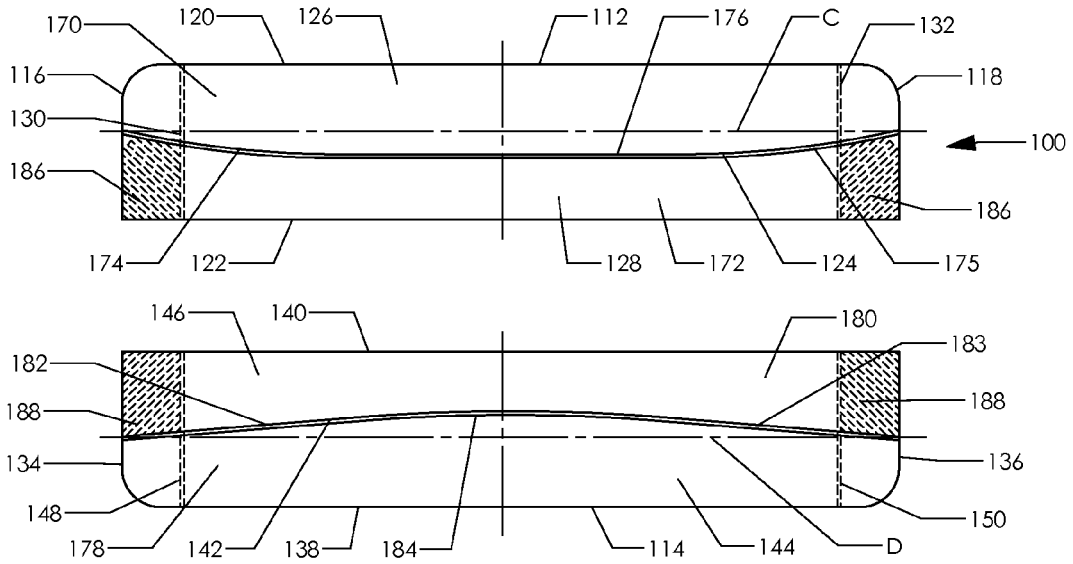
FIG. 13 is a top view of a closure mechanism assembly opposing sealing structures in a flat position in accordance with another embodiment.

FIG. 13 depicts is a top view of a closure mechanism assembly, generally designated 100 having the opposing sealing structures 112 and 114 in a flat position in accordance with another embodiment. Note that the closure mechanism assembly 100 may be used with a container similar to that of FIGS. 3A-3B for example. As illustrated, the first flat, strip like sealing structure 112 has a first orientation defined with respect to a length of the flat, strip like sealing structure 112, and has a first end 116, a second end 118 opposite the first end 116, a first edge 120; and a second edge 122 opposite the first edge 120. The first flat, strip like sealing structure 112 includes a first or horizontal pivot member 124 substantially parallel to the first orientation extending between the first end 116 and the second end 118 and dividing the first flat, strip like sealing structure 112 into an first or upper portion 126 proximate the first edge 120 and a second or lower portion 128 proximate the second edge 122. In the illustrated embodiment, the first flat, strip like sealing structure 112 includes at least one but generally two second or vertical pivot members 130 and 132, each pivot member 130 and 132 has a straight contour and are located proximate the first end 116 and the second end 118, where the pivot members 130 and 132 having an orientation substantially perpendicular to the first orientation.

In the illustrated embodiment, the second flat, strip like sealing structure 114 has a first orientation defined with respect to a length of the flat, strip like sealing structure 114, and has a first end 134, a second end 136 opposite the first end 134, a first edge 138; and a second edge 140 opposite the first edge 138. The second flat, strip like sealing structure 114 includes a first or horizontal pivot member 142 substantially parallel to the first orientation extending between the first end 134 and the second end 136 and dividing the second flat, strip like sealing structure 114 into an first or upper portion 144 proximate the first edge 138 and a second or lower portion 146 proximate the second edge 140. In the illustrated embodiment, the second flat, strip like sealing structure 114 includes at least one but generally two second or vertical pivot members 148 and 150, each pivot member 148 and 150 has a straight contour and are located proximate the first end 134 and the second end 136, where the pivot members 148 and 150 having an orientation substantially perpendicular to the first orientation. The first flat, strip like sealing structure 112 and the second flat, strip like sealing structure 114 are comprised of any suitable material including a semi-rigid and flexible plastic material. The plastic material may be selected from the group comprising at least polypropylene, polyethylene or some combination thereof. It is contemplated that the sealing structures may be comprised of the same or different material. For example, one sealing structure may be comprised of polypropylene while the other is comprised of polyethylene.

FIG. 13 illustrates the first flat, strip like sealing structure 112 having a tab member 170 located in the first portion 126 of the first flat, strip like sealing structure 112, the tab member 170 enabled to pivot about the first pivot member 124 between a first flat position to a second bent position, providing a surface region for a user to apply pressure. The first flat, strip like sealing structure 112 further includes a sealing member 172 located in the second portion 128 of the first flat, strip like sealing structure 112 and coupled to the tab member 170 via the horizontal pivot member 124. FIG. 13 further illustrates the first flat, strip like sealing structure 112 defines an axis C with respect to the first orientation. The first flat, strip like sealing structure 112 further includes a horizontal pivot member 124 with a contour including two curved portions 174 & 175 and a linear portion 176. The curved portions 174 & 175 have a large gradual radius intersecting at least one of the first end 116 and the second end 118. The linear portion 176 is substantially parallel with respect to the axis C and intersects the curved portions 174 & 175, the one curved portions 174 & 175 tangent to and intersecting the liner portion 176.

The second flat, strip like sealing structure 114 as illustrated has a tab member 178 located in the first portion 144 of the second flat, strip like sealing structure 114, the tab member 178 enabled to pivot about the first pivot member 142 between a first flat position to a second bent position, providing a surface region for a user to apply pressure. FIG. 13 further depicts the second flat, strip like sealing structure 114 having a sealing member 180 located in the second portion 146 of the second flat, strip like sealing structure 114 and coupled to the tab member 178 via the horizontal pivot member 142. FIG. 13 further illustrates the second flat, strip like sealing structure 114 defines an axis D with respect to the first orientation. The second flat, strip like sealing structure 114 further includes a first pivot member 142 with a contour including at least two linear portions 182 & 183 and a curved portion 184. The curved portion 184 has a large gradual radius and intersecting at least one of the linear portions 182 & 183. The linear portions 182 & 183 have a slight draft at a selected angle with respect to the axis D and intersecting and tangent to the curved portion 184 and intersecting at least one of the first end 134 and second end 136. In at least one embodiment, the selected angle of the slight draft is between about 0 and 5 degrees with respect to the axis D.

Figure 14:
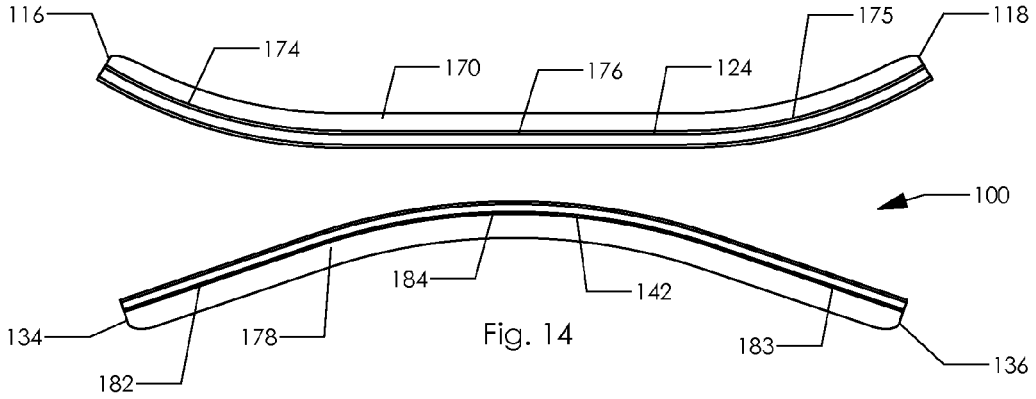
FIG. 14 is a top view of the closure mechanism assembly with opposing sealing structures separated and pivoting about a horizontal pivot member in accordance with another embodiment.
Figure 15:
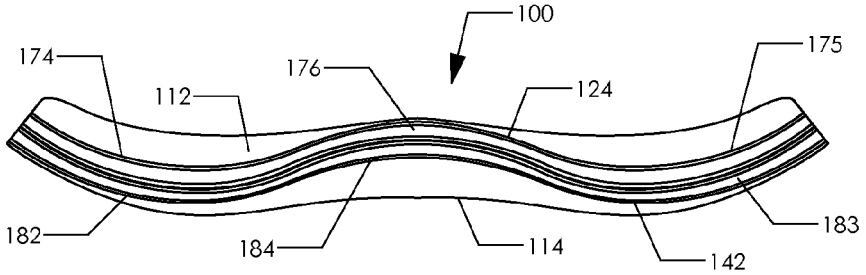
FIG. 15 is a top view of the opposing sealing structure mated and joined at ends creating an air tight closure mechanism in accordance with another embodiment.

FIG. 14 depicts a top view of the closure mechanism 100 with sealing structures 112 and 114 separated pivoting about horizontal pivot members 124 & 142, while FIG. 15 is a top view of the opposing sealing structures mated and joined at ends 116, 118, 134 & 136, creating an air tight closure mechanism. As provided previously, the first flat, strip like sealing structure 112 has the sealing member 172 located in the second portion 128 and coupled to the tab member 170 via the horizontal pivot member 124, while the second flat, strip like sealing structure 114 has the sealing member 180 located in the second portion 146 of the second flat, strip like sealing structure 114 and coupled to the tab member 178 via the horizontal pivot member 142, whereby the sealing members 172 & 180 are joined, providing a sealing interface between the first flat, strip like sealing structure 112 and the second flat, strip like sealing structure 114 (best viewed in FIG. 15). FIG. 13 further illustrates the first flat, strip like sealing structure 112 and the second, flat strip like sealing structure 114 each include a bonding area 186 and 188. As illustrated, the first flat, strip like sealing structure 112 has two bonding areas 186 located proximate the first and second ends 116 & 118, while the second, flat strip like sealing structure 114 likewise has two bonding areas 188 located proximate the first and second ends 134 & 136.

Figure 16:
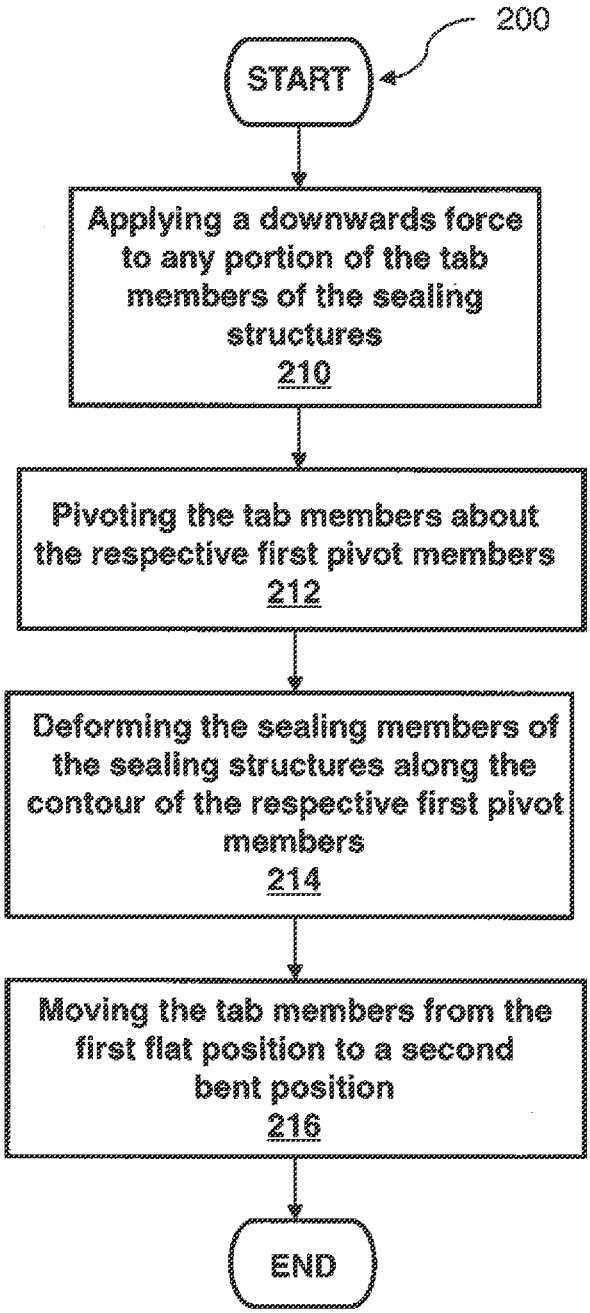
FIG. 16 is a high level flow diagram illustrating a method of sealing a container in accordance with one embodiment.

In at least one embodiment, the linear portion 176 of the first flat, strip like sealing structure 112 mates proximate the curved portion 184 of the second flat, strip like sealing structure 114, while linear portions 182 & 183 of the second flat, strip like sealing structure 114 mate proximate the curved portions 174 & 175 of first flat, strip like sealing structure 112 (best viewed in FIGS. 14-15). Pivoting the tab members 170 & 178 imparts a deformation of at least one or both of the two flat, strip like sealing structures 112 & 114 resembling the contour of the first pivot members 124 & 142. FIG. 16 depicts a high level flow diagram illustrating a method of sealing a container, generally designated 200, in accordance with one embodiment. Method 200 includes accessing a resealable container as provided above, using one or more of the closure mechanisms described herein. Method 200 includes applying a downwards force relative to the orientation of the instant closure mechanism to any portion of the tab members of the first sealing structure and/or the second sealing structure, box 210. The tab members of the first sealing structure and the second sealing structure are pivoted about the respective first pivot members, box 212; and the sealing members of the first sealing structure and the second sealing structure are deformed along the contour of the respective first pivot members, box 214. Method 200 further includes moving the tab members of the first sealing structure and the second sealing structure from the first flat position to a second bent position, whereby the linear portion of the first sealing structure follows the contour of the curved portion of the second sealing structure, the curved portion of the second sealing structure applying a pressure to the linear portion of the first sealing structure, the deformation of the first sealing structure creating a tensioning effect between the first end and second end thereby creating a sealing pressure between the first sealing structure and the second sealing structure, and further whereby the linear portion of the second sealing structure follows the contour of the curved portion of the first sealing structure, the curved portion of the first sealing structure applying a pressure to the linear portion of the second sealing structure, the deformation of the second sealing structure creating a tensioning effect between the first end and second end thereby creating a sealing pressure between the first sealing structure and the second sealing structure, box 216.

Figure 17A:
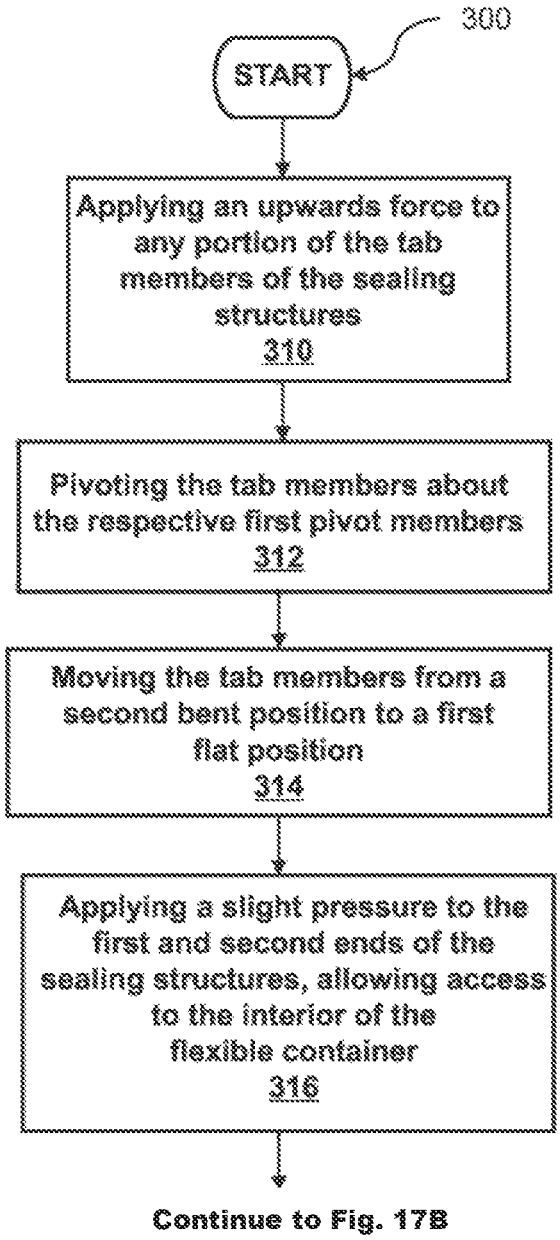
FIG. 17A is a first portion of a high level flow diagram illustrating a method of accessing and sealing a container in accordance with one embodiment.
Figure 17B:
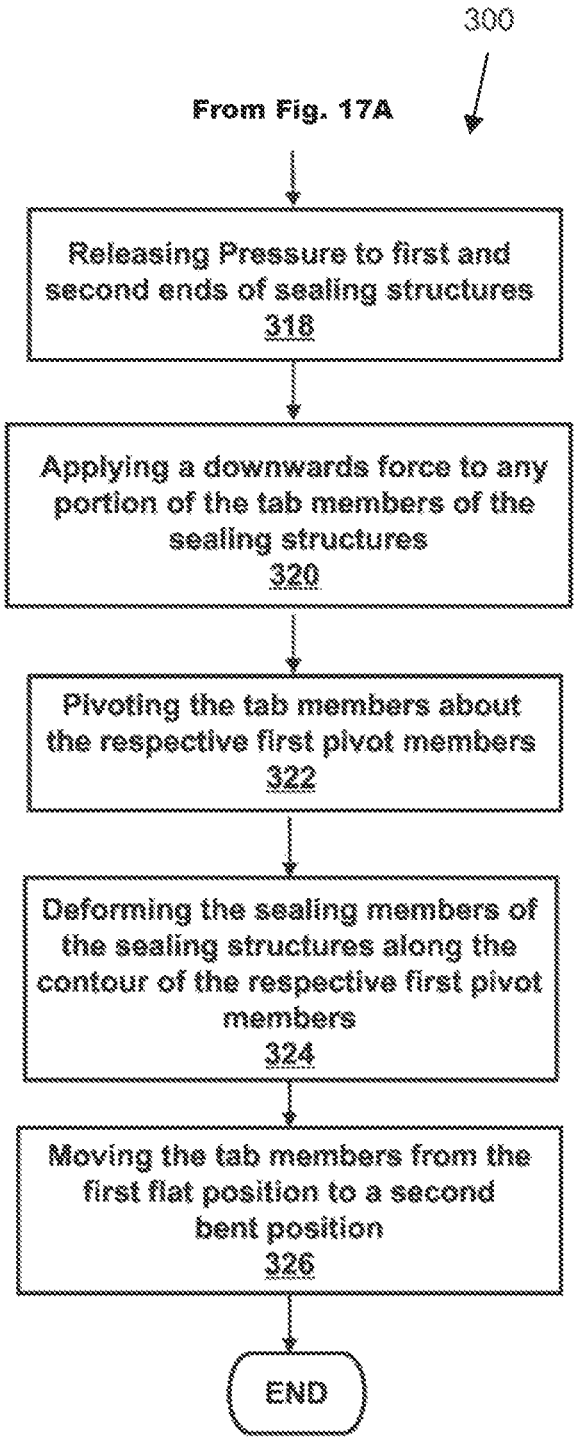
FIG. 17B is a second portion of the high level flow diagram of FIG. 17A.

FIGS. 17A-17B depict a high level flow diagram illustrating a method of accessing and sealing a container, generally designated 300, in accordance with one embodiment using one or more of the closure mechanisms and/or containers described herein. Method 300 illustrates applying an upwards force relative to the orientation of the instant closure mechanism to any portion of the tab members of the first sealing structure and/or the second sealing structure, box 310. The tab members of the first sealing structure and the second sealing structure are pivoted about the respective first pivot members, box 312. The tab members of the first sealing structure and the second sealing structure are moved from the second bent position to the first flat position. The method 300 further includes applying a slight pressure to the first ends and second ends of the first sealing structure and the second sealing structure, resulting in the first sealing structure and the second sealing structure separating, thereby allowing access to the interior of the flexible container, box 316.

Method 300 further includes releasing pressure to the first end and second end of the first sealing structure and the second sealing structure, returning the first sealing structure and the second sealing structure to the first flat position, box 318. Method 300 includes applying a downwards force relative to the orientation of the instant closure mechanism to any portion of the tab members of the first sealing structure or the second sealing structure, box 320. The tab members of the first sealing structure and the second sealing structure are pivoted about the respective first pivot members, box 322; and the sealing members of the first sealing structure and the second sealing structure are deformed along the contour of the respective first pivot members, box 324. Method 300 further includes moving the tab members of the first sealing structure and the second sealing structure from the first flat position to a second bent position, whereby the linear portion of the first sealing structure follows the contour of the curved portion of the second sealing structure, the curved portion of the second sealing structure applying a pressure to the linear portion of the first sealing structure, the deformation of the first sealing structure creating a tensioning effect between the first end and second end thereby creating a sealing pressure between the first sealing structure and the second sealing structure, and further whereby the linear portion of the second sealing structure follows the contour of the curved portion of the first sealing structure, the curved portion of the first sealing structure applying a pressure to the linear portion of the second sealing structure, the deformation of the second sealing structure creating a tensioning effect between the first end and second end thereby creating a sealing pressure between the first sealing structure and the second sealing structure, box 326.

Figure 18:
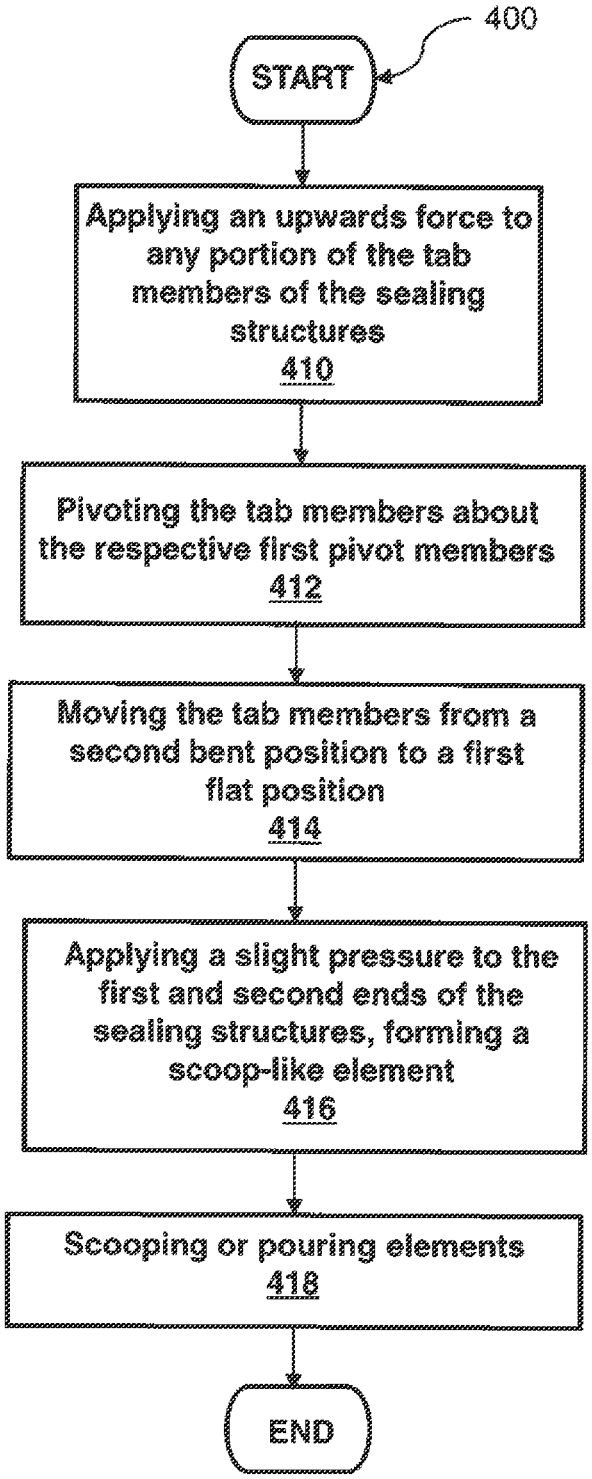
FIG. 18 is a high level flow diagram illustrating a method of scooping and pouring elements in accordance with one embodiment.

FIG. 18 depicts a high level flow diagram illustrating a method scooping and pouring elements, generally designated 400, in accordance with one embodiment using one or more of the closure mechanisms and/or containers described herein. Method 400 illustrates applying an upwards force relative to the orientation of the instant closure mechanism to any portion of the tab members of the first sealing structure or the second sealing structure, box 410. The tab members of the first sealing structure and the second sealing structure are pivoted about the respective first pivot members. The tab members of the first sealing structure and the second sealing structure are moved from the second bent position to the first flat position, box 414. Method 400 further includes applying a slight pressure to the first ends and second ends of the first sealing structure and the second sealing structure, resulting in the first sealing structure and the second sealing flexing, forming a scoop-like element, box 414. Elements are scooped or poured elements using the scoop-like element, box 418.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. An instant closure mechanism, comprising:

a first flat, strip like sealing structure having a first orientation defined with respect to a length of the first sealing structure, the first sealing structure having:

a first end;

a second end opposite the first end;

a first edge;

a second edge opposite the first edge;

a first pivot member substantially parallel to the first orientation extending between the first end and the second end and dividing the first structure into a first portion proximate the first edge and a second portion proximate the second edge, and having a contour including at least one curved portion having a large gradual radius intersecting at least one of the first end and the second end;

at least two second pivot members each having a straight contour and located proximate the first end and the second end, the pivot members having an orientation substantially perpendicular to the first orientation;

a tab member located in the first portion, the tab member enabled to pivot about the first pivot member between a first flat position and a second bent position, providing a surface region for a user to apply pressure; and a sealing member located in the first sealing structure second portion and coupled to the tab member via the first pivot member; and a second flat, strip like sealing structure having a first orientation defined with respect to a length of the second sealing structure and positioned relative to the first sealing structure, the second sealing structure having:

a first end;

a second end opposite the first end;

a first edge;

a second edge opposite the first edge;

a first pivot member substantially parallel to the first orientation extending between the first end and the second end and dividing the second sealing structure into a first portion proximate the first edge and a second portion proximate the second edge, and having a contour including at least one curved portion having a large gradual radius intersecting at least one of the first end and the second end;

at least two second pivot members each having a straight contour and located proximate the first end and the second end, the pivot members having an orientation substantially perpendicular to the first orientation;

a tab member located in the first portion, the tab member enabled to pivot about the first pivot member between a first flat position and a second bent position; and a sealing member located in the second sealing structure second portion and coupled to the tab member via the first pivot member, whereby the sealing members are joined, providing a sealing interface between the first sealing structure and the second sealing structure;

wherein the contour of the pivot member of the first sealing structure including at least one linear portion having a slight draft at a selected angle with respect to an axis defined between the first end and the second end of the first sealing structure and intersecting at least one of the first end and the second end of the first sealing structure, the at least one curved portion tangent to the linear portion;

wherein the contour of the pivot member of the second sealing structure including at least one linear portion having a slight draft at a selected angle with respect to an axis defined between the first end and the second end of the second sealing structure and intersecting at least one of the first end and the second end of the second sealing structure, the at least one curved portion tangent to the linear portion, whereby the linear portion of the first sealing structure mates proximate the curved portion of the second sealing structure and the linear portion of the second sealing structure mates proximate the curved portion of first sealing structure;

wherein the first sealing structure and second sealing structure are in a closed and locked configuration where pivoting the tab member of the first sealing structure about the first pivot member of the first sealing structure imparts a deformation of the sealing member of the first sealing structure resembling the contour of the first pivot member of the first sealing structure and pivoting the tab member of the second sealing structure about the first pivot member of the second sealing structure imparts a deformation of the sealing member of the second sealing structure resembling the contour of the first pivot member of the second sealing structure; and wherein the mating of the linear portion of the sealing member of the first sealing structure about the curved portion of the sealing member of the second sealing structure resulting in a deformation of the linear portion of the sealing member of the first sealing structure following the contour of the curved portion of the sealing member of the second sealing structure thereby preventing the first tab member from pivoting about the first pivot member of the first sealing structure, creating a locking effect of the tab member of the first sealing structure.

2. The mechanism of claim 1 wherein the first sealing structure and the second sealing structure are movable into a flat, closed and unlocked configuration where the tab member of the first sealing structure is parallel to the sealing member of first sealing structure and the tab member of the second sealing structure is parallel to the sealing member of the second sealing structure.

3. The mechanism of claim 1 wherein the first sealing structure and second sealing structure are movable into an open configuration where the tab member and sealing member of the first sealing structure pivot about the second pivot members of the first sealing structure and the tab member and sealing member of the second sealing structure pivot about the second pivot members of the second sealing structure thereby creating an separation between the first sealing structure and the second sealing structure.

4. The mechanism of claim 1 wherein the deformation of the sealing member of the first sealing structure and the sealing member of the second sealing structure results in a tensioning force applied between opposing ends of the closure mechanism, thus creating a sealing pressure between mating surfaces of the sealing member of the first sealing structure and the sealing member of the second sealing structure.

5. The mechanism of claim 1 wherein the selected angle of the slight drafts is between about 0 and 5 degrees with respect to the axis.

6. The mechanism of claim 1 wherein the first sealing structure and the second sealing structure further including a bonding area proximate the first end and second end of the first sealing structure and the second sealing structure, whereby the first sealing structure is bonded to the second sealing structure.

7. The mechanism of claim 6 wherein the first sealing structure is bonded to the second sealing structure using at least one of an adhesive bonding, heat sealing, over molding, or ultrasonic welding process.

8. The mechanism of claim 1 wherein the first sealing structure and the second sealing structure are selected from the group comprising a semi-rigid and flexible plastic material.

9. The mechanism of claim 8 wherein the plastic material is selected from the group comprising polypropylene and polyethylene.

10. The mechanism of claim 1 wherein the contour of the first pivot member of the first sealing structure includes at least two curved portions and a linear portion, the at least two curved portions located proximate to and intersecting the first end and the second end, the at least two curved portions tangent to the linear portion; and wherein the contour of the first pivot member of the second sealing structure includes at least two linear portions and a curved portion, the at least two linear portions located proximate to and intersecting the first end and the second end and the linear portions having a slight draft at a selected angle with respect to an axis, the curved portion tangent to the at least two linear portions.

11. An instant closure mechanism, comprising:

a first flat, strip like sealing structure having a first orientation defined with respect to a length of the first sealing structure, the first sealing structure having:

a first end;

a second end opposite the first end;

a first edge;

a second edge opposite the first edge;

a first pivot member substantially parallel to the first orientation extending between the first end and the second end and dividing the first structure into a first portion proximate the first edge and a second portion proximate the second edge, and having a contour including at least one curved portion having a large gradual radius intersecting at least one of the first end and the second end;

at least two second pivot members each having a straight contour and located proximate the first end and the second end, the pivot members having an orientation substantially perpendicular to the first orientation;

a tab member located in the first portion, the tab member enabled to pivot about the first pivot member between a first flat position and a second bent position, providing a surface region for a user to apply pressure; and a sealing member located in the first sealing structure second portion and coupled to the tab member via the first pivot member; and a second flat, strip like sealing structure having a first orientation defined with respect to a length of the second sealing structure and positioned relative to the first sealing structure, the second sealing structure having:

a first end;

a second end opposite the first end;

a first edge;

a second edge opposite the first edge;

a first pivot member substantially parallel to the first orientation extending between the first end and the second end and dividing the second sealing structure into a first portion proximate the first edge and a second portion proximate the second edge, and having a contour including at least one curved portion having a large gradual radius intersecting at least one of the first end and the second end;

at least two second pivot members each having a straight contour and located proximate the first end and the second end, the pivot members having an orientation substantially perpendicular to the first orientation;

a tab member located in the first portion, the tab member enabled to pivot about the first pivot member between a first flat position and a second bent position; and a sealing member located in the second sealing structure second portion and coupled to the tab member via the first pivot member, whereby the sealing members are joined, providing a sealing interface between the first sealing structure and the second sealing structure;

wherein the contour of the pivot member of the first sealing structure including at least one linear portion having a slight draft at a selected angle with respect to an axis defined between the first end and the second end of the first sealing structure and intersecting at least one of the first end and the second end of the first sealing structure, the at least one curved portion tangent to the linear portion;

wherein the contour of the pivot member of the second sealing structure including at least one linear portion having a slight draft at a selected angle with respect to an axis defined between the first end and the second end of the second sealing structure and intersecting at least one of the first end and the second end of the second sealing structure, the at least one curved portion tangent to the linear portion, whereby the linear portion of the first sealing structure mates proximate the curved portion of the second sealing structure and the linear portion of the second sealing structure mates proximate the curved portion of first sealing structure;

wherein the first sealing structure and second sealing structure are in a closed and locked configuration where pivoting the tab member of the first sealing structure about the first pivot member of the first sealing structure imparts a deformation of the sealing member of the first sealing structure resembling the contour of the first pivot member of the first sealing structure and pivoting the tab member of the second sealing structure about the first pivot member of the second sealing structure imparts a deformation of the sealing member of the second sealing structure resembling the contour of the first pivot member of the second sealing structure; and wherein the mating of the linear portion of the sealing member of the second sealing structure about the curved portion of the sealing member of the first sealing structure resulting in a deformation of the linear portion of the sealing member of the second sealing structure following the contour of the curved portion of the sealing member of the first sealing structure thereby preventing the tab member of the second sealing structure from pivoting about the first pivot member of the second sealing structure thus creating a locking effect of the tab member of the second sealing structure.

12. The mechanism of claim 11 wherein the first sealing structure and the second sealing structure are movable into a flat, closed and unlocked configuration where the tab member of the first sealing structure is parallel to the sealing member of first sealing structure and the tab member of the second sealing structure is parallel to the sealing member of the second sealing structure.

13. The mechanism of claim 11 wherein the first sealing structure and second sealing structure are movable into an open configuration where the tab member and sealing member of the first sealing structure pivot about the second pivot members of the first sealing structure and the tab member and sealing member of the second sealing structure pivot about the second pivot members of the second sealing structure thereby creating an separation between the first sealing structure and the second sealing structure.

14. The mechanism of claim 1 wherein the deformation of the sealing member of the first sealing structure and the sealing member of the second sealing structure results in a tensioning force applied between opposing ends of the closure mechanism, thus creating a sealing pressure between mating surfaces of the sealing member of the first sealing structure and the sealing member of the second sealing structure.

15. The mechanism of claim 1 wherein the selected angle of the slight drafts is between about 0 and 5 degrees with respect to the axis.

16. The mechanism of claim 11 wherein the first sealing structure and the second sealing structure further including a bonding area proximate the first end and second end of the first sealing structure and the second sealing structure, whereby the first sealing structure is bonded to the second sealing structure.

17. The mechanism of claim 16 wherein the first sealing structure is bonded to the second sealing structure using at least one of an adhesive bonding, heat sealing, over molding, or ultrasonic welding process.

18. The mechanism of claim 11 wherein the first sealing structure and the second sealing structure are selected from the group comprising a semi-rigid and flexible plastic material.

19. The mechanism of claim 18 wherein the plastic material is selected from the group comprising polypropylene and polyethylene.

20. The mechanism of claim 11 wherein the contour of the first pivot member of the first sealing structure includes at least two curved portions and a linear portion, the at least two curved portions located proximate to and intersecting the first end and the second end, the at least two curved portions tangent to the linear portion; and wherein the contour of the first pivot member of the second sealing structure includes at least two linear portions and a curved portion, the at least two linear portions located proximate to and intersecting the first end and the second end and the linear portions having a slight draft at a selected angle with respect to an axis, the curved portion tangent to the at least two linear portions.

* * * * *